US008037553B2

(12) United States Patent
Ware

(10) Patent No.: US 8,037,553 B2
(45) Date of Patent: Oct. 18, 2011

(54) TANKLESS VENTILATED TOILET WITH BIDET

(76) Inventor: Derrick Ware, Atlanta, GA (US)

( * ) Notice: Subject to any disclaimer, the term of this patent is extended or adjusted under 35 U.S.C. 154(b) by 1298 days.

(21) Appl. No.: 11/668,104

(22) Filed: Jan. 29, 2007

(65) Prior Publication Data

US 2008/0222784 A1 Sep. 18, 2008

(51) Int. Cl.
*A47K 3/20* (2006.01)
*E03D 9/04* (2006.01)
*E03D 9/05* (2006.01)

(52) U.S. Cl. ..... 4/420.5; 4/347; 4/348

(58) Field of Classification Search ..... 4/420.5, 4/420.4, 420.1, 420.2, 332, 313, 432, 433
See application file for complete search history.

(56) References Cited

U.S. PATENT DOCUMENTS

| | | | | |
|---|---|---|---|---|
| 5,187,816 | A * | 2/1993 | Chiou | 4/313 |
| 5,502,845 | A * | 4/1996 | Hayashi et al. | 4/332 |
| 5,680,879 | A * | 10/1997 | Sheih et al. | 4/226.1 |
| 6,675,399 | B1 * | 1/2004 | Tomita et al. | 4/420.4 |
| 6,678,900 | B2 * | 1/2004 | Ware | 4/347 |
| 7,191,473 | B2 * | 3/2007 | Matsumoto et al. | 4/420.4 |

* cited by examiner

*Primary Examiner* — Gregory Huson
*Assistant Examiner* — Bradley Oliver
(74) *Attorney, Agent, or Firm* — Laurence P. Colton; Smith Risley Tempel Santos LLC

(57) ABSTRACT

The present invention provides a toilet and/or a toilet and bidet combination having immediate reflush capability. Preferred embodiments comprise a tankless toilet and/or toilet and bidet combination and a bowl ventilation apparatus integrated therein. The tankless nature of the invention saves space over conventional toilets, allowing closer mounting to the wall and a lower vertical profile. More specifically, certain embodiments of the present invention comprise a motorized flush mechanism with an infrared sensor having immediate reflush capability, a on-demand motorized water spray cleansing system integrated therein and an integrated bowl ventilation apparatus with a proximity sensor.

16 Claims, 1 Drawing Sheet

TANKLESS VENTILATED TOILET WITH BIDET

BACKGROUND OF THE INVENTION

1. Technical Field

The present invention generally relates to toilets, and more particularly relates to a combination feature-rich tankless toilet and bidet system with a bowl ventilation apparatus.

2. Related Art

Conventional toilets include a porcelain body defining a bowl and a toilet flushing mechanism. Known flushing mechanisms comprise a water tank reservoir mounted on a rear portion of the toilet in fluid communication with a water supply pipe, e.g., city water service or the like, and the bowl. This is the typical flushing mechanism found in home toilets. Other known flushing mechanisms comprise a valve directly in communication with the water supply. This is the typical flushing mechanism found in commercial toilets.

The water tank reservoir is to supply sufficient water under enough pressure to cleanse the debris, from the bowl. To accomplish this, a siphon effect is utilized. This requires a sufficient volume water running into the bowl with sufficient velocity to activate the siphon. As a result, normal house water pipe water pressure, without more, will not activate the siphon. Essentially, the tank acts as a capacitor, holding one to several gallons of water, which it takes perhaps 30 to 60 seconds to accumulate for storage until the next flush. Activation of the flushing mechanism results in all of the water in the tank rapidly pouring into the bowl.

Typical flushing activation methods include a manual lever connected to a chain that lifts a flush valve to uncover a siphon hole in the tank floor. Once the tank has emptied, the flush valve reengages the siphon hole, covering it so the tank can be refilled. During refill, some of the water goes down a refill tube and starts refilling the tank. The rest goes through the bowl refill tube, and down the overflow tube into the bowl. This refills the bowl slowly. As the water level in the tank rises, so does a float device. Eventually the float rises far enough to turn a valve off, shutting the refill water off, indicating the water storage tank is full and ready for another flush. As discussed above, during the refill time a proper flush is not possible, a waiting period is required.

The bidet is well known and is used for hand-free cleansing of the perineal and genital areas, either as a stand-alone device or in combination with the toilets described above. Generally, a conventional bidet is adapted to spray water from a nozzle. Stand-alone bidets take up much needed bathroom space. Toilet-bidet combinations require water in the water tank reservoir as described above, thus requiring space in the bathroom environment. Moreover, such toilet-bidet combinations may not have sufficient water reserves to provide satisfactory cleansing at certain periods of time, e.g., during a flush or during the tank refill period following a flush.

Bathroom fans are a primary method of removing odors in a bathroom environment arising from toilet usage. Typically, these fans draw air nonspecifically from the bathroom environment and either recirculate the drawn air back into the bathroom, sometimes through a filter, or disperse the drawn air in alternative locations or environments. As these fans are usually in ceilings or high up on the wall, it can take a significant amount of time for odors to travel or be drawn from the toilet bowl region to the fan for removal. During this time, the user and subsequent users of the bathroom are exposed to these odors, which can be unpleasant.

Because bathroom fans can take a significant amount of time to replace, recirculate and/or cleanse the air in a bathroom environment, the user often is forced to open a window to augment odor removal. Although opening a window can help cleanse the air in a bathroom environment, the opening of a window exposes the bathroom to the external environment, subjecting the bathroom and the user to possible extremes in temperature and humidity, depending on the geographic location and the season. Further, additional resources such as electricity or natural gas may need to be expended to heat or cool the bathroom. Further complicating this situation, opening a window could result in dust and allergens entering into the bathroom environment, which can be harmful to some users and/or require the bathroom to be cleaned more often.

Often, bathroom fans are electrically connected to the light switch such that when the light switch is activated, the fan is activated. This can result in a waste of electricity for the times when the bathroom light is needed, but the fan is not needed. Alternatively, there may be a second switch for the fan alone. However, this requires the user to both remember that there is a second switch to activate the fan, and to actually activate the switch.

A bowl ventilation apparatus is a more efficient alternative to the conventional bathroom fan. A ventilation apparatus may be mounted on or incorporated within the structure of a toilet bowl for the specific removal of odors therein. A proximity sensor may be incorporated into, or proximal, the ventilation apparatus to allow activation upon detection of a person approaching or occupying the toilet. Such an apparatus is described by the inventor of the present invention in U.S. Pat. Nos. 6,550,072 and 6,678,900, the disclosures of which are hereby incorporated in their entirety.

Thus, a tankless toilet having immediate reflush capability, without a waiting period is needed. Similarly, a tankless toilet and bidet combination having both immediate reflush capability as well as on-demand water cleansing spray availability before, during and alter a flush is needed. A tankless toilet and a toilet and bidet combination are also needed to save valuable bathroom space and allow installation in small areas. The addition of a bowl ventilation apparatus is needed to maximize efficiency. The present invention is directed to these needs.

BRIEF SUMMARY OF THE INVENTION

The present invention provides a combination toilet and/or a toilet and bidet combination having immediate reflush capability, touchless flushing capability, and integrated odor ventilation. Preferred embodiments comprise a tankless toilet and/or toilet and bidet combination and a bowl ventilation apparatus integrated therein. The tankless nature of the invention saves space over conventional toilets, allowing closer mounting to the wall and a lower vertical profile. More specifically, certain embodiments of the present invention comprise a motorized flush mechanism with an infrared sensor having immediate reflush capability, an on-demand motorized water spray cleansing system integrated therein and an integrated bowl ventilation apparatus with a proximity sensor.

The invention preferably comprises a touchless flushing mechanism, such as an infrared sensor, allowing the user to flush the toilet without touching the toilet. Further, the invention preferably comprises a touchless ventilation means, such as a pressure switch activated by the toilet seat, allowing the ventilation fan to be actuated without the user touching the toilet. Both of the touchless components increase the hygiene level of the invention and can help to provide a cleaner and more sanitary restroom environment.

A feature of the invention is a tankless toilet and/or a tankless toilet and bidet combination having immediate reflush capability. Another feature of the invention is a tankless toilet and bidet combination having on-demand access to the water cleansing spray at all times. A further feature of the invention is a tankless toilet having immediate reflush capability and an integrated bowl ventilation apparatus. Yet another feature of the invention is a tankless toilet and bidet combination having immediate reflush capability, on-demand water spray availability and an integrated bowl ventilation apparatus. These features and other features and advantages of the present invention will become more apparent to those of ordinary skill in the relevant art when the following detailed description of the preferred embodiments is read in conjunction with the appended drawings in which like reference numerals designate like components throughout the several views.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF PREFERRED EMBODIMENTS

Figure 1:
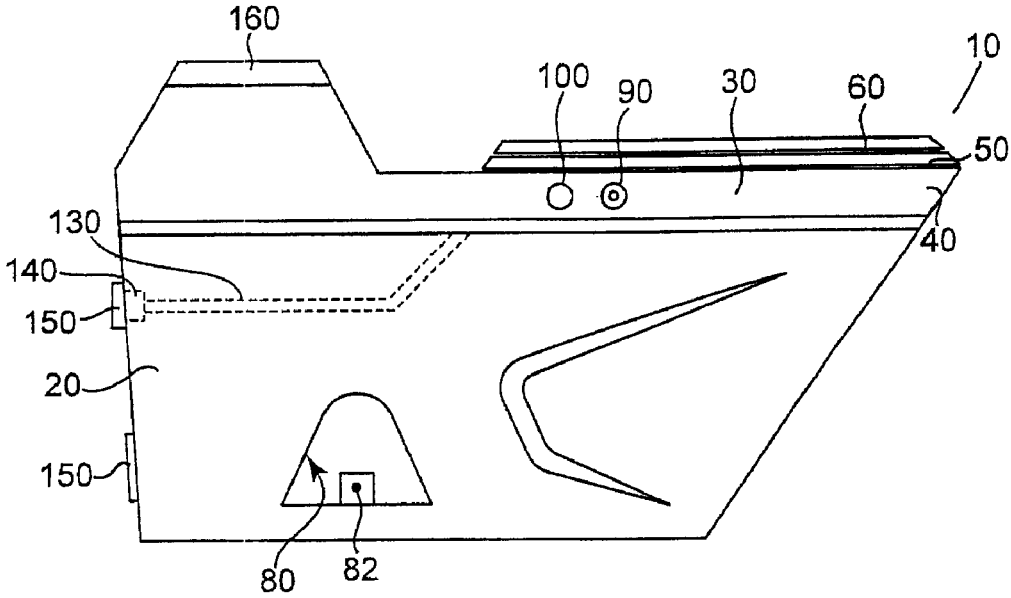
FIG. 1 illustrates a side view of one embodiment of an apparatus of the present invention.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

FIG. 1 illustrates one embodiment of the present invention. Here, a tankless toilet and bidet combination 10 is provided comprising a body 20 and a bowl 30 with a rim 40 circumferentially defining the upper inner portion of the bowl 30. The rim 40, as is well known in the art, preferably comprises water dispensing holes (not shown) around the circumference of the rim 40. The flush water is dispensed into the bowl 30 through the water dispensing holes of the rim 40. A toilet seat 50 and lid 60 are pivotally attached to a rear portion of the body 20 by fastening means well known to those skilled in the art. The toilet body 20 is secured or attached to the bathroom floor (not shown) through use of common fastening methods such as floor bolts and reciprocating nuts 82. Access port 80 may be provided to allow access to the fastening nut and bolts 82 as well as water shut off valves (not shown).

As illustrated, the well-known conventional toilet water tank reservoir is absent in the present invention as will be discussed herein further. As a result, the present invention requires less bathroom space to install. Thus, the tankless invention 10 may be installed closer to the wall than conventional tank toilets owing to the absence of the tank. In addition, the tankless invention 10 has a lower vertical profile than conventional tanks for the same reason.

For the toilet component of the invention, a flush actuator 90 is disposed on the toilet body 20. In a preferred embodiment, the flush actuator 90 is infrared and placed on or near, i.e. proximal, the toilet body so that a user may activate the sensor 90 by swiping a hand across the actuator 90. Other flush actuator 90 mounting locations may be readily apparent to those skilled in the art and are within the scope of the present invention. Further, other flush actuators will readily present themselves to those skilled in the art. For example, a manual button, switch, lever or the like may be used to actuate the flushing mechanism. As disclosed in more detail below, flush actuator 90 is operationally connected to the flush mechanism by, for example, electrical wires or radio frequency or optical transmitters and receivers.

For the bidet component of the invention, bidet features of the water spray cleansing mechanism of the present embodiment comprise, inter alia, a water cleansing spray actuator 100 disposed on or near, i.e., proximal, the toilet body 20 and accessible to a user seated thereon. The water cleansing spray actuator 100 allows a user to actuate a cleansing spray to the seated user's underside. The water cleansing spray actuator 100 may be an infrared sensor or a manual button, switch, lever or the like.

For the ventilation component of the invention, a bowl ventilation mechanism is operationally attached to the bowl 20 and comprises intake duct 120, powered exhaust fan 140, ventilation hose 130 connected between the intake duct 120 and powered exhaust fan 140, air exhaust duct 150, and switch or proximity sensor 230. Switch or proximity sensor 230 may be used to activate the bowl ventilation mechanism when a user pivots the toilet seat 50 down onto the switch or the user or the toilet seat 50 is detected or sensed proximal the bowl 30.

Figure 2:
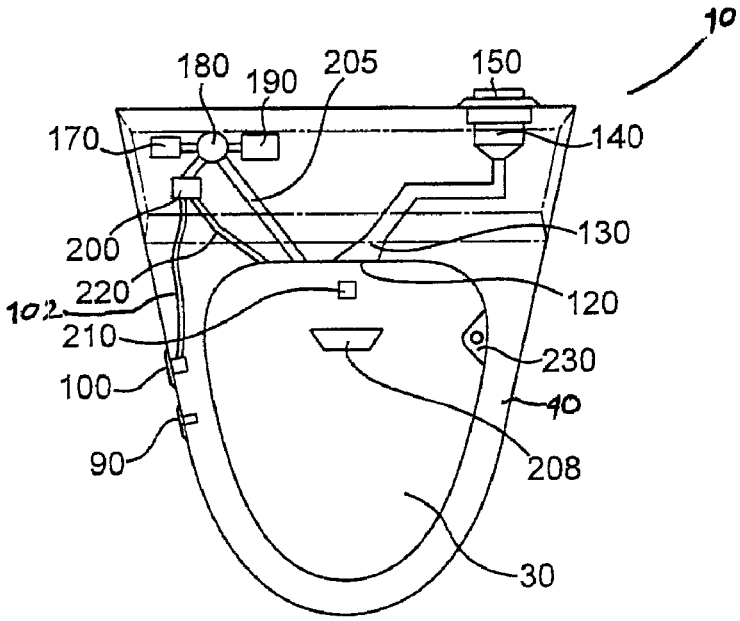
FIG. 2 illustrates a top cutaway view of one embodiment of an apparatus of the present invention.

One embodiment of the bowl ventilation mechanism is provided partly in phantom view in FIG. 1. The bowl ventilation mechanism comprises an air intake duct 120, the general location of which is shown in FIG. 2. The air intake duct 120 is preferably integrates into the toilet body 20 at the rim 40 as is further illustrated and described in U.S. Pat. Nos. 6,550,072 and 6,678,900 by the inventor, the disclosures of which are incorporated herein by reference in their entirety. A ventilation hose 130 is connected between the intake duct 120 and a powered exhaust fan 140 that is, in turn, connected to an air exhaust duct 150, the mechanism thus allowing fluid communication with the toilet bowl 30 and any odorous air contained therein.

A removable mechanical access cover 160 is provided to allow access to the mechanical elements located within the toilet body 20 as will be further discussed in connection with FIG. 2.

FIG. 2 provides a top cutaway view of the invention so that the internal features of the illustrated embodiment may be shown. A water inlet 170, connected to an external water supply line (not shown), is illustrated in fluid communication with a valve 180. The water inlet 170 provides source water for the flush and bidet water cleansing mechanisms. This illustrative embodiment of the tankless flush mechanism comprises the water inlet 170 in fluid communication with the external water line, valve 180 in fluid communication with the water inlet 170, a first motorized pump 190, the flush actuator 90 in communication with pump 190 as is well known in the art, and a flush conduit 205 in fluid communication with the water inlet 170, valve 180, first motorized pump and the water dispensing holes (not shown) that are disposed around the toilet bowl rim 40. The first motorized pump 190, operationally connected to the toilet body 20, preferably comprises an integrated electric motor as is well known to those skilled in the art. Alternatively, first motorized pump 190 may be driven by an external electric motor. Valve 180 is opened to fluid communication with conduit 205 during flushing and closed to conduit 205 at all other times. The tankless flushing mechanism is operationally connected with the bowl 30.

In operation, the flush mechanism is activated by the toilet user actuating the flush actuator 90. In the illustrated embodiment the actuator 90 is an infrared sensor that may be actuated, by, e.g., swiping a hand proximally across the face of the infrared actuator 90. The actuator 90 is in communication with the first motorized pump 190 which is activated thereby. Although not shown in detail, the actuator 90 can be operationally connected to the first motorized pump via manual rods and levers, electrical wiring, radio frequency or optical transmitters and receivers, and any other common, known, and future developed components.

The activated first motorized pump 190 urges water from the external water line through the water inlet 170, through opened valve 180 and flush conduit 205 and to the toilet bowl rim 40 where the water rushes downwardly through the water dispensing holes of the rim 40. The water entering the bowl 30 is in sufficient volume and comprising sufficient force and velocity that the siphon effect is activated and the contents of the bowl rush downwardly through sewage hole 208 and out to an external sewage line. First motorized pump 190 may comprise a timer that terminates its operation after a selected period of time. Alternatively, a water volume calculation mechanism may be integrated into the pump 190 so that the pump 190 is deactivated after the selected volume of water has been urged through the flushing mechanism. Such devices are known. When the flush is complete, pump 190 ceases motorized pumping and valve 180 closes to conduit 205, thus stopping the flow of water into the bowl 30.

Because the flush mechanism of the present invention uses a motorized pump to deliver a steady supply of water in sufficient volume and with sufficient velocity to the bowl 30 to activate the desired debris-cleansing siphon effect, the conventional water reservoir tank is not necessary. As a result, the tankless toilet and toilet-bidet combination of the present invention is able to be mounted closer to the wall, reducing the overall floor footprint space required for installation, and presents a lower vertical profile than conventional toilets.

The illustrated embodiment of the tankless bidet water cleansing spray mechanism is operationally connected to the bowl 30 and comprises the water inlet 170, valve 180, a second motorized pump 200, the water spray cleansing actuator 100 in communication with motorized pump 200, a nozzle 210 mounted in the bowl 30 and a water spray conduit 220. Water spray actuator 100 is illustrated as an actuable button, with electrical connecting lines 102 in communication with second motorized pump 200. Similar to the flush actuator 90, the water spray actuator 100 can be operationally connected to the second motorized pump via manual rods and levers, electrical wiring, radio frequency or optical transmitters and receivers, and any other common, known, and future developed components.

The nozzle 210 in fluid communication with the water spray conduit 220, valve 180, water inlet 170 and the external water line when valve 180 is open to conduit 220. Valve 180 is opened to conduit 220 during water spray cleansing and closed to conduit 220 at all other times. It is understood that valve 180 may allow simultaneous flushing and water spray cleansing to occur, thus valve 180 may be open to conduit 205 and conduit 220 simultaneously. In an alternate embodiment, valve 180 may allow only one of flushing or water spray cleansing, in other words opening to either conduit 205 or conduit 220, but not both simultaneously. In another alternate embodiment, separate valves 180 may be disposed between first motorized pump 190 and flush conduit 205 and between second motorized pump 200 and water spray conduit 220. Such valves 180 are well known to those skilled in the art.

In operation, the water spray cleansing mechanism is activated by a user actuating the water spray actuator 100, thus activating the second motorized pump 200. Second motorized pump 200 urges water from the external water line through opened valve 180 into the water spray conduit 220 and through the spray nozzle 210. If actuated during a flush, first and second motorized pumps 190, 200 operate simultaneously to drive the flush mechanism and the water spray cleansing mechanism, respectively as described above. Water spray actuator 100 can be configured to cause a burst of water, and thus successive activations of water spray actuator 100 would be necessary to cause a succession of water bursts, or to cause a continuous spray of water.

It is further understood that one alternate embodiment of the present invention does not comprise the water cleansing spray mechanism. Instead, such alternate embodiment comprises the flush mechanism as described above. As a result of the motorized pumping of water by the water cleansing spray mechanism, the present invention does not require a conventional water reservoir tank to provide the continuously available on-demand water cleansing spray of the present invention.

The second motorized pump 200, as described above in connection with the flushing mechanism, preferably comprises an integrated electric motor. Alternatively, second motorized pump 200 may be driven by an external electric motor. In this alternative embodiment, both first and second motorized pumps 190, 200 may be driven by a single external electric motor.

The bowl ventilation mechanism is operationally attached to the bowl 20 and comprises intake duct 120, powered exhaust fan 140, ventilation hose 130 connected between the intake duct 120 and powered exhaust fan 140, air exhaust duct 150, and proximity sensor 230. In various embodiments, exhaust fan may comprise a self-contained driving motor or may be driven by one of the first or second motors 190, 200, wherein the exhaust fan 140 is in driving communication with either the first 190 or second 200 motor and actuated by proximity sensor 230. Proximity sensor 230 may be used to activate the bowl ventilation mechanism when a user is detected or sensed proximal the bowl 30.

Proximity sensor 230 can be used to activate the ventilation mechanism when a person is detected proximal to toilet 100. Generally, proximity sensor 230 can be defined as a device that specifically deals with sensing the nearness or closeness of a person or object. For example, proximity sensor 230 can emit a light or radio frequency that, when interrupted at a certain distance, causes exhaust fan 140 to activate. Such a distance preferably is short, on the order of millimeters or centimeters, to prevent exhaust fan 140 from activating when someone just happens to be passing by. It is preferable that the interruption is continuous so as to keep exhaust fan 140 activated. Otherwise, the moment the person moves out of the frequency range, i.e., no longer proximal to the toilet, the proximity sensor 230 will switch to the off position, deactivating exhaust fan 140. Proximity sensor 230 preferably would not activate exhaust fan 140 unless and until the user actually sits on the toilet and remains seated. Methods and devices that can be used to embody proximity sensor 230 are known to those of ordinary skill in the art.

FIG. 2 illustrates one embodiment of proximity sensor 230 as an infrared sensor located on the inner edge of rim 40. In this embodiment, lowering toilet seat 50 will affect or activate proximity sensor 25. However, when toilet seat 50 is lowered and the user sits on toilet seat 50, the user's body would then be proximal to proximity sensor 230, thus activating proximity sensor 230 which, in turn, communicates with and activates the powered exhaust fan 140. When the user's body or the toilet seat 50 is no longer proximal to the proximity sensor 230, the proximity sensor 230 ceases to communicate with the exhaust fan 140 and the exhaust fan 140 is deactivated or turned off. Thus, in this embodiment, the person or user or toilet seat must come in close proximity to, and remain in close proximity to, the proximity sensor 230 to keep proximity sensor 230 activated.

More alternatively, proximity sensor 230 can be a remote structure from toilet 10. In this embodiment, proximity sensor 230 can be placed at any location proximal to toilet 10 where a person or object would remain close to sensor 230. In FIG. 2, proximity sensor 230 is shown on toilet rim 40, but those skilled in the art will readily recognize a plurality of different and equivalent mounting locations, each of which is within the scope of the present invention. In this embodiment, the person or user must come in close proximity to, and remain in close proximity to, proximity sensor 230 to keep proximity sensor 230 activated.

Another advantage of proximity sensor 230 is that it can conserve power. More particularly, proximity sensor 230 can help ensure that powered exhaust fan 140 is not powered when a person is not using toilet 10. Preferably, proximity sensor 230 will not activate ventilation fan unit 30 when a person walks by proximity sensor 25. More preferably, proximity sensor 230 is designed to be sensitive enough so that it only activates exhaust fan 140 when a person is using and remains seated on toilet 10. Not only does this invention save power, but also it promotes less wear and tear on the exhaust fan 140.

Proximity sensor 230 may comprise at least one manual switch (not shown) for turning exhaust fan 140 on and off. In one embodiment, an automatic switch may be used, i.e., a depressible switch that is in the on position when depressed and is in the off position when extended or released, is used. This on/off configuration can allow ventilation mechanism to be turned on by the combined applied pressure from the weight of toilet seat 50 and the weight of the toilet user on toilet seat 50. More specifically, toilet seat 50 is rotated downward from the raised position to the lowered position so that is rests on proximity sensor 230; and once a user sits on toilet seat 50, proximity sensor 230 is depressed fully which can activate exhaust fan 140 and thus the ventilation mechanism. In this embodiment, when the weight of the user is removed from toilet seat 50, proximity sensor 230 is deactivated. This can be accomplished by many known means, the most typical of which is a spring-loaded proximity sensor 230 whose spring has sufficient force to urge the weight of toilet seat 50 upwards, thus deactivating proximity sensor 230. Alternatively, proximity sensor 230 can be activated by only from the pressure of the weight of toilet seat 50 on proximity sensor 230.

In another embodiment, a manual switch (not shown), which can be any type of switch, is used by a user to activate and deactivate the ventilation mechanism. For example, manual switch can be a depressible switch, a lever switch, a rotatable switch, a rocker switch or the like. The manual switch can allow a user to turn on ventilation mechanism without having to sit on toilet seat 50 or place toilet seat 50 in a lowered position or combination thereof. Manual switch can be helpful if the user desires ventilation mechanism to remain activated after the user gets off the toilet seat 50 or to be on before the user sits on the toilet seat 50. Further, a manual switch can allow the user to keep the ventilation mechanism in the off or deactivated position, this allows a user to keep the unit off when the unit is not working properly and when the user does not desire to use the apparatus. It is understood that every embodiment of the present invention need not have such a manual switch.

Exhaust fan 140, first motorized pump 190 and second motorized pump 200 require energy to perform their respective functions. Although such power source can be derived from numerous sources, preferably the power source is household alternating current (AC) current supplied by adapter plug (not shown) that fits into a standard electrical outlet, as this power source present in most households. Alternatively, the exhaust fan 140, motorized pump 190 and/or motorized pump 200 could be directly configured into the standard electric grid of the building or house. Alternatively, the power source could be derived from a battery or standard electric current reduced to the equivalency of a battery.

The various plumbing components of the present invention are interconnected and cooperate in known manners. For example, as the connections between pipes and the manners for preventing pipes carrying fluids are well known and conventional, these features are not essential for a proper understanding of the invention The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. A tankless toilet having a toilet body defining a bowl in fluid communication with an external water line, the bowl capable of containing water and waste; and a sewage hole within the bowl, the sewage hole in fluid communication with an external sewage line; the improvement comprising:

a) a tankless flushing mechanism operationally connected to the bowl comprising:

i) a first motorized pump operationally connected to toilet body and in fluid communication with the external water line;

ii) a flush water conduit in fluid communication with the first motorized pump, and iii) a touchless flush actuator mounted proximal the toilet body, the flush actuator in communication with the first motorized pump for activating and deactivating the first motorized pump, wherein the flush actuator is activated by swiping a hand across the actuator;

b) a water cleansing spray mechanism operationally connected to the bowl for cleansing the perineal area of a user comprising:

i) a spray nozzle disposed within the bowl;

ii) a water spray conduit in fluid communication with the spray nozzle; and iii) a second motorized pump in fluid communication with the water spray conduit, the spray nozzle and an external water line, wherein the second motorized pump urges water from the external water line and spray water conduit through the spray nozzle, iv) a water spray cleansing actuator mounted proximal the toilet body, the water spray cleansing actuator in communication with the second motorized pump for activating and deactivating the second motorized pump, wherein the water spray cleansing actuator is activated by swiping a hand across the actuator; and a bowl ventilation mechanism operationally attached to the bowl for removing air from the bowl, comprising:

i) a powered exhaust fan that is activated to urge removal of air from the bowl, and ii) a proximity sensor proximal the bowl and in communication with the powered exhaust fan, whereby the proximity sensor senses the presence of a user or a toilet seat and activates the exhaust fan, and senses the absence of the user or the toilet seat and deactivates the exhaust fan.

2. The toilet of claim 1, wherein the first motorized pump urges a sufficient volume of water from the external water line through the flush water conduit and into the bowl with sufficient force to create a flush, wherein the bowl water and waste are siphoned down the sewage hole and out of the bowl.

3. The toilet of claim 2, further comprising a valve in fluid communication with the flush mechanism and disposed between the first motorized pump and the flush water conduit.

4. The toilet of claim 1, wherein the flush actuator comprises an infrared sensor.

5. The toilet of claim 1, wherein the tankless flushing mechanism is capable of repeated flushes without a waiting period therebetween.

6. The toilet of claim 1, wherein the water spray cleansing actuator comprises an infrared sensor.

7. The toilet of claim 1, wherein the tankless flushing mechanism is capable of repeated flushes without a waiting period therebetween, and wherein the activated second motorized pump urges water through the spray nozzle during each flush of the tankless flushing mechanism.

8. The toilet of claim 1, wherein the tankless flushing mechanism is capable of repeated flushes without a waiting period therebetween and wherein the activated second motorized pump urges water through the spray nozzle after the each flush of the tankless flushing mechanism.

9. The toilet of claim 1, wherein the proximity sensor comprises an infrared sensor.

10. The toilet of claim 1, wherein the proximity sensor is only activated when the user is seated on the toilet.

11. The toilet of claim 1, wherein the proximity sensor is only activated when the toilet seat is lowered.

12. The toilet of claim 1, wherein the proximity sensor senses the presence of the user and activates the exhaust fan, and senses the absence of the user and deactivates the exhaust fan.

13. The toilet of claim 12, wherein the proximity sensor is only activated when the user is seated on the toilet.

14. The toilet of claim 1, wherein the proximity sensor senses the presence of the toilet seat and activates the exhaust fan, and senses the absence of the toilet seat and deactivates the exhaust fan.

15. The toilet of claim 14, wherein the proximity sensor is only activated when the toilet seat is lowered.

16. The toilet of claim 15, wherein the proximity sensor is only activated when the user is seated on the toilet.

* * * * *